United States Patent [19]

Sutton

[11] 4,209,031

[45] Jun. 24, 1980

[54] POSITIVE CONTROL VALVE ASSEMBLY

[75] Inventor: Gary Sutton, Kalamazoo, Mich.

[73] Assignee: General Signal Corporation, Stamford, Conn.

[21] Appl. No.: 874,175

[22] Filed: Feb. 1, 1978

[51] Int. Cl.[2] ..... F15B 11/08; F15B 13/042

[52] U.S. Cl. ..... 137/106; 91/420

[58] Field of Search ..... 91/420, 445; 251/228; 137/106

[56] References Cited

U.S. PATENT DOCUMENTS

| | | | |
|---|---|---|---|
| 2,502,800 | 4/1950 | Renick | 91/420 |
| 2,505,527 | 4/1950 | Court | 91/420 |
| 2,574,969 | 11/1951 | Heidloff | 251/228 X |
| 3,155,114 | 11/1964 | Ruhl | 91/420 X |
| 3,213,874 | 10/1965 | Schmiel et al. | 91/420 |
| 3,369,566 | 2/1968 | Schmitt et al. | 251/228 X |
| 3,398,927 | 8/1968 | Ruter | 251/228 |
| 3,854,499 | 12/1974 | Sievenpiper | 137/596.2 |
| 3,855,902 | 12/1974 | Kirst | 91/420 |

FOREIGN PATENT DOCUMENTS

| | | | |
|---|---|---|---|
| 175678 | 6/1961 | Sweden | 91/420 |

*Primary Examiner*—Irwin C. Cohen

*Attorney, Agent, or Firm*—Pollock, Vande Sande & Priddy

[57] ABSTRACT

The hydraulic control valve assembly of the present invention functions to positively control the movement of a fluid powered motor unit, wherein the control valve comprises a manually slidable spool which allows hydraulic fluid to be selectively introduced into the fluid powered motor; the valve assembly further includes a piston stem-valve assembly which prevents actuation of the fluid motor in a specific direction unless the pressure in the load chamber of the fluid motor exceeds the pressure in the venting chamber by a predetermined amount.

9 Claims, 4 Drawing Figures

A
N
B
T

POSITIVE CONTROL VALVE ASSEMBLY

BACKGROUND OF THE INVENTION

This invention relates to a novel control valve assembly adaptable for use in controlling the movement of a fluid powered motor unit. In particular, the present invention is directed to a spool-type hydraulic control valve interrelated with a stem-type check valve assembly.

Fluid power motors have many uses, as for example, controlling the pivoting motion of a loaded forklift arm. A serious problem arises when it is desired to pivot an elevated load in a direction away from the motor unit in that the weight of the load tends to increase the pivoting speed of the arm faster than the drive chamber of the fluid motor can be filled with pressurized hydraulic fluid. The lack of sufficient hydraulic fluid creates a cavity in the loading chamber preventing the fluid powered motor from accurately controlling and stopping the pivoting motion of the elevated load, resulting in serious damage to the forklift mechanism.

In an attempt to solve the above-stated problem, the industry has turned to a variety of control devices, including both tilt lock mechanisms and check valve assemblies. None of the prior art devices known to the applicant have proved satisfactory in providing an economical, unitary device for positively controlling the movement of a fluid powered motor which prevents leakage in the hydraulic fluid circuitry and drift induced by the weight of the load.

SUMMARY OF THE INVENTION

It is an object of the present invention to provide an inexpensive control valve assembly which positively controls the motion of a fluid powered motor unit subject to a variable loading condition.

Another object of the present invention is to provide a simplified control assembly including a tilt lock mechanism interrelated with a check valve assembly which prevents uncontrolled movement of the fluid powered motor as well as leakage of hydraulic fluid.

A further object of the present invention is to provide a control valve assembly which prevents hydraulic fluid from leaving the vent chamber of the fluid motor until a sufficient amount of hydraulic fluid has entered the drive chamber, which assures the movement of the load is controlled by only the fluid motor unit, rather than the weight of the load.

The hydraulic control valve assembly of the present invention includes a control spool member adaptable at being manually set in one of three control positions. When the spool member is preset in the neutral position, it prevents hydraulic fluid from either entering or leaving the fluid powered motor and associated fluid lines. When it is desired to pivot the elevated load, the control spool is manually moved to one of two active positions. Movement of the control spool to a first active position allows pressurized hydraulic fluid to unseat a stem-type check valve and flow into one side of the fluid powered motor, while the hydraulic fluid initially in the motor's opposite chamber is allowed to flow through the control device into the reservoir tank, whereby the fluid motor operates to pivot the elevated load in a first direction relative to the forklift vehicle. When the control spool is moved to the second active position, pressurized hydraulic fluid is allowed to flow directly into one chamber of the fluid motor, while hydraulic fluid already present in the opposite chamber of the fluid motor is prevented from venting by the check valve assembly, until the pressure in the drive chamber exceeds the pressure in the venting chamber by a predetermined amount, whereby a piston positioned within the control spool unseats the stem-type check valve allowing hydraulic fluid to vent from the control motor. This allows the control motor to pivot the elevated load only as long as the pressure of the hydraulic fluid in the drive chamber exceeds the pressure of the hydraulic fluid in the venting chamber by the predetermined amount.

Other advantages inherent in the present invention will become apparent in the following description.

BRIEF DESCRIPTION OF THE DRAWINGS

The hydraulic control valve assembly according to the invention will be described in more detail with reference to the accompanying drawings, in which.

DETAILED DESCRIPTION OF THE PREFERRED EMBODIMENT

Figure 1:
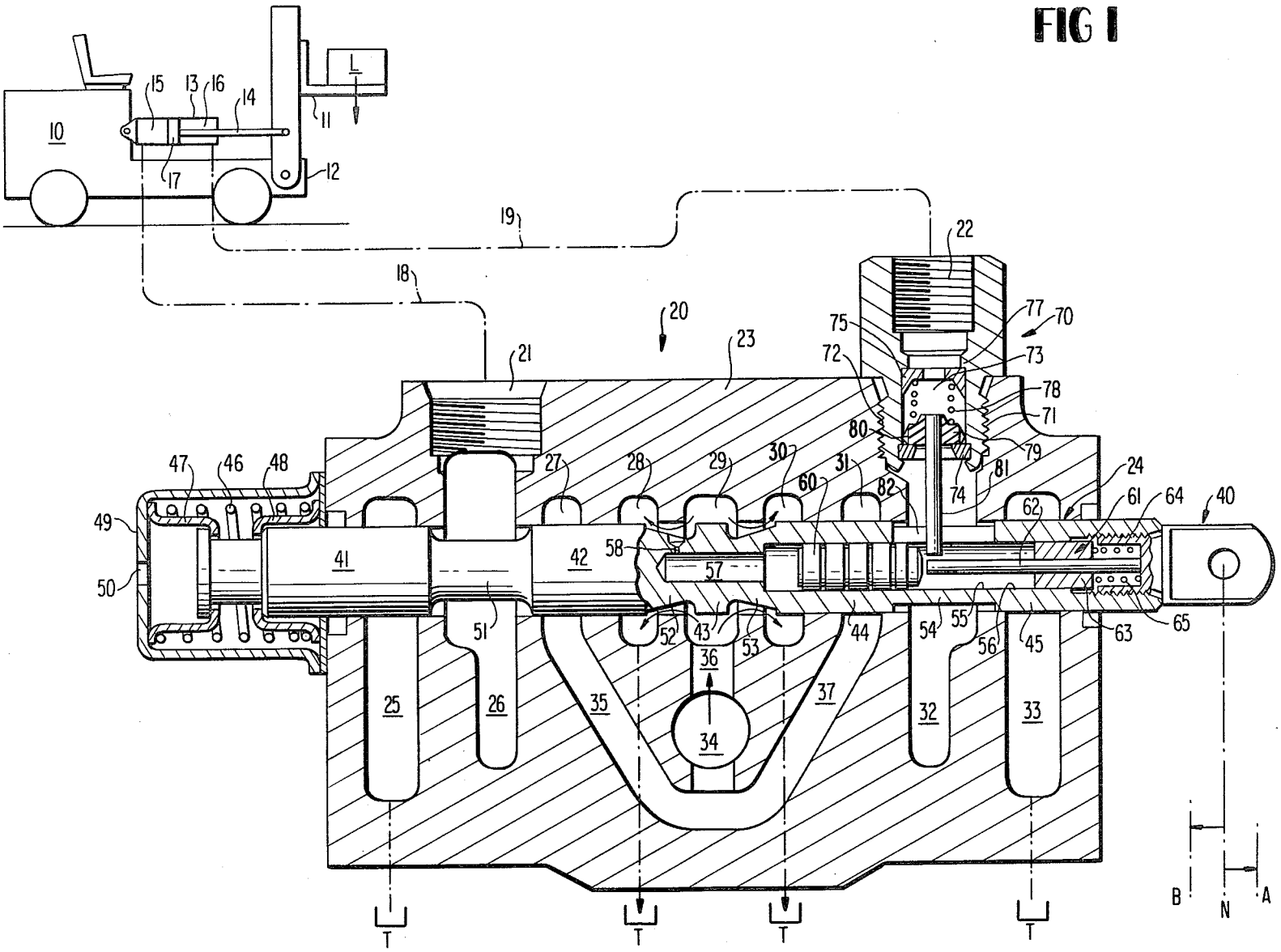
FIG. 1 shows a schematic view of the hydraulic control valve assembly wherein the control spool is in the neutral position N.

The following is a detailed description of a preferred embodiment of the present invention, with reference being had to the drawings in which like reference numerals are used to identify similar elements of structure in each of the figures.

Referring to FIG. 1, numeral 10 designates a forklift type vehicle including a support arm 11 pivotally attached to a body 12 of the vehicle 10. The arm 11, which supports an elevated load L, is selectively pivotable through actuation of fluid powered motor unit 13.

The motor unit 13 is attached to body 12 and includes a connecting rod 14 pivotally fastened to support arm 11. The motor comprises a pair of fluid chambers 15 and 16 separated by a piston 17 integrally attached to connecting rod 14.

The fluid powered motor 13 is selectively actuated to pivot support arm 11 by introducing hydraulic fluid into one of the chambers 15 or 16, while simultaneously venting the remaining chamber. If one of the chambers is vented faster than the drive chamber can be filled, the piston 17 will be increasingly drawn toward the venting chamber by the weight of the load, creating a cavitation in the loading chamber which reduces the ability of the fluid motor 13 to accurately control the position of the arm 11 and L. As will be discussed more fully hereafter, the present invention provides a control valve assembly which positively prevents cavitation from occurring within the fluid motor 13, while also preventing any hydraulic fluid from leaking through the control valve assembly.

A hydraulic control valve assembly 20 includes a pair of hydraulic fluid ports 21 and 22, with a pair of fluid conduits 18 and 19 extending between chambers 15 and 16 of fluid motor 13 and ports 21 and 22 of control valve assembly 20. A constant volume pump P (not shown) supplies a steady stream of pressurized hydraulic fluid which is selectively directed through either port 21 or 22 of valve 20, into chambers 15 or 16 of motor 13.

Control valve assembly 20 comprises a valve body 23 which includes a central passageway 24 extending lengthwise therethrough. Valve body 23 further includes a plurality of spaced cavities 25–33, with each cavity in fluid communication with central passageway 24. Cavities 25, 28, 30 and 33 are each connected by fluid passageways (shown in phantom) to a common hydraulic fluid reservoir tank T, while cavities 26 and 32 are connected to ports 21 and 22, respectively. Finally, cavities 27, 29, and 31 are directly connected to pump P via a central passageway 34 and additional connecting passageways 35, 36, and 37, respectively.

A cylindrically shaped spool member 40 comprises a plurality of spaced lands 41–45 and is slidably positioned within passageway 24. Spool 40 is biased into a first, or neutral position N, by a compression spring 46 which engages a pair of circular flange members 47 and 48 mounted on spool 40. A hollow frame 49 surrounds spring 46 and includes a well known vent aperture 50.

Spool 40 further comprises a plurality of connecting portions 51–54 of reduced cross-section which interconnects with lands 41–45, respectively. Connecting portion 51 includes a pair of curved end portions joining lands 41 and 42.

Connecting portions 52 and 53 taper from lands 42 and 44, respectively, toward the inner sidewalls of land 43.

Spool 40 is formed with a blind bore 55 extending partially therethrough and comprising a first cylindrical portion 56 of enlarged diameter and a second, adjoining cylindrical portion 57 of reduced diameter. A narrow vent 58 extends through spool 40 from passageway 24 into portion 57 of internal bore 55.

A cylindrically shaped piston 60 is slidably positioned within the first cylindrical portion 56 between an end wall joining portions 56 and 57 and a separate stop assembly 61. Stop assembly 61 comprises a rod member 62 which extends through, and is supported by, a hollow support member 63. Fastened at one end of rod 62 is a hollow flange member 64 which is biased into contact with spool 40 by a compression spring 65 positioned between support member 63 and flange 64.

A stem-type check valve assembly 70 includes a threaded section 71 adaptable to being threaded into corresponding threaded section 72 formed in body 23 of the control valve assembly 20.

Check valve assembly 70 further includes a fluid passageway 73 extending from port 22 to cavity 32. A pair of spaced, hollow resilient sealing rings 74 and 75 are positioned within passageway 73. Sealing ring 74 seats against an inwardly curved portion 76 of check valve assembly 70, while sealing ring 75 is forced to seat against an inwardly extending boss portion 77 of check valve assembly 70 by a compression spring member 78. Spring 78 is compressed between resilient ring 75 and a cylindrically shaped resilient sealing member 79.

Sealing member 79 is forced by spring 78 into abutting contact with hollow ring 74, whereby sealing member 79 is of a sufficient diameter so as to block the fluid passageway 73 through hollow ring 74. Sealing member 79 further includes a plurality of grooves 80 which allow fluid to flow past member 79 at specified times to be described hereafter. Finally, sealing member 79 is fastened to a rod 81 which extends through passageway 73, cavity 32, an elongated aperture 82 formed in the spool 40 and into cylindrical portion 56 of bore 55.

The operation of the preferred embodiment of the present invention will now be described with reference to the accompanying drawings.

In FIG. 1, control valve assembly 20 is in the neutral position as indicated by the N connected by phantom line to spool 40. Hydraulic fluid pumped by pump P passes through passageways 34 and 36 into cavity 29. Because of the position of spool 40, the hydraulic fluid is able to pass directly into cavities 28 and 30, as shown by the directional arrows. The hydraulic fluid then flows directly back to reservoir tank T.

Port 21 is blocked from fluid communication with either pump P or tank T by the position of spool 40. In a like manner, check valve 70 prevents fluid from venting through valve assembly 20 from chamber 16 of motor unit 13, while spool 40 itself prevents additional hydraulic fluid from entering fluid motor 13, whereby the fluid in chambers 15 and 16 of motor 13 remains stable to prevent support arm 11 and load L from pivoting in either direction relative to vehicle body 12.

Figure 2:
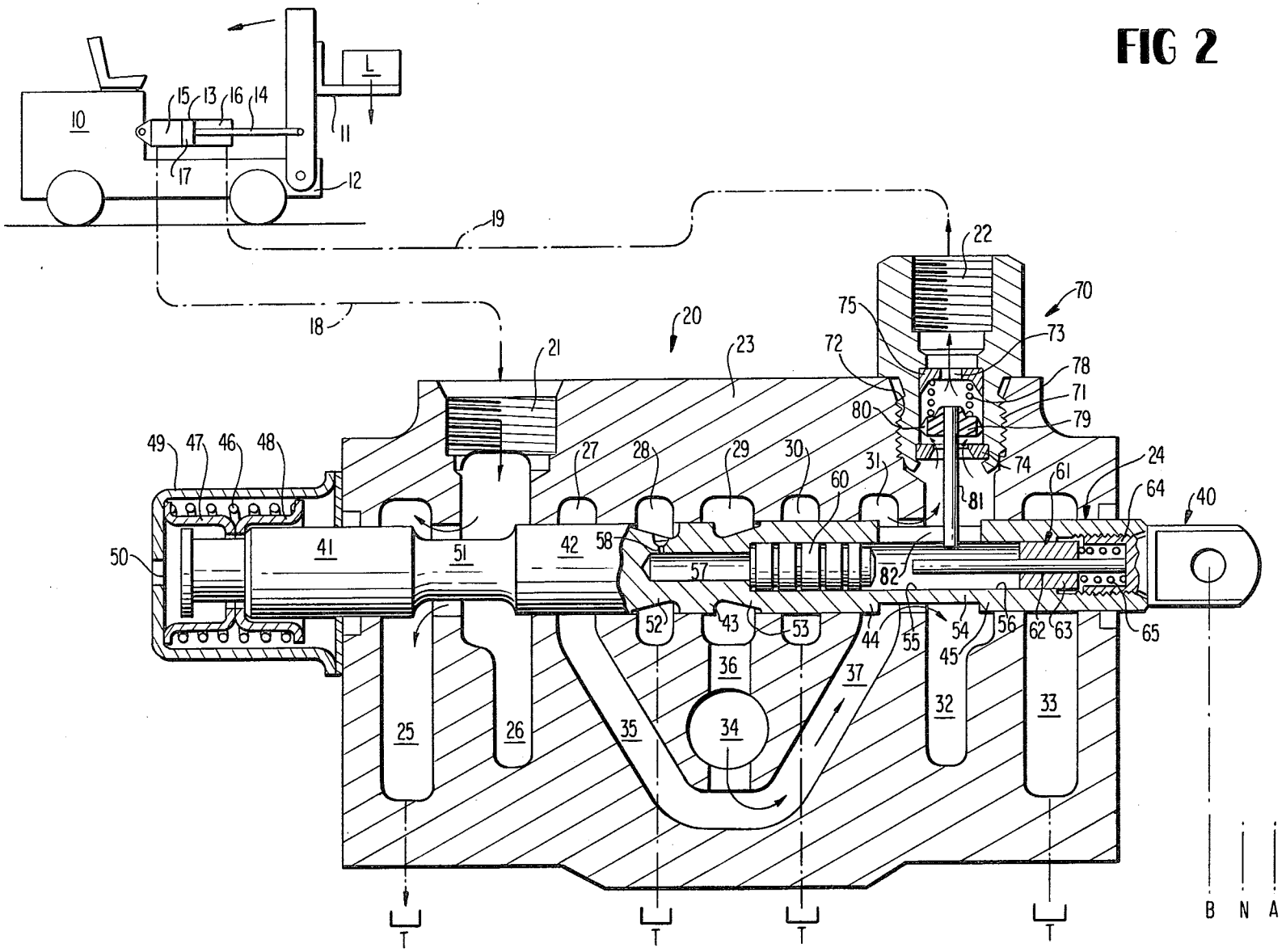
FIG. 2 shows a schematic representation of the hydraulic control assembly wherein the control spool is preset into a first active position B.

Referring now to FIG. 2, the spool 40 has been manually moved to the B position as indicated by the phantom line. This opens a fluid passageway between cavities 26 and 25 which allows the hydraulic fluid in chamber 15 to drain into reservoir tank T. Portions of spool 40 are now in position to block the passageways between cavities 28, 29 and 30, while a new passageway is simultaneously opened between the pump P, passageway 37, cavity 31 and cavity 32. Pressurized hydraulic fluid overcomes compression spring 78 and forces sealing member 79 out of abutting contact with sealing member 74. The hydraulic fluid can then flow through grooves 80 and directly into chamber 16. The increased pressure in chamber 16 forces piston 17 and attached rod 14 to move toward venting chamber 15, resulting in the counterclockwise rotation of support arm 11. If spool 40 is selectively moved to the N position, the support arm 11 and load L would become fixed in space relative to vehicle body 12.

Figures 3, 3A:
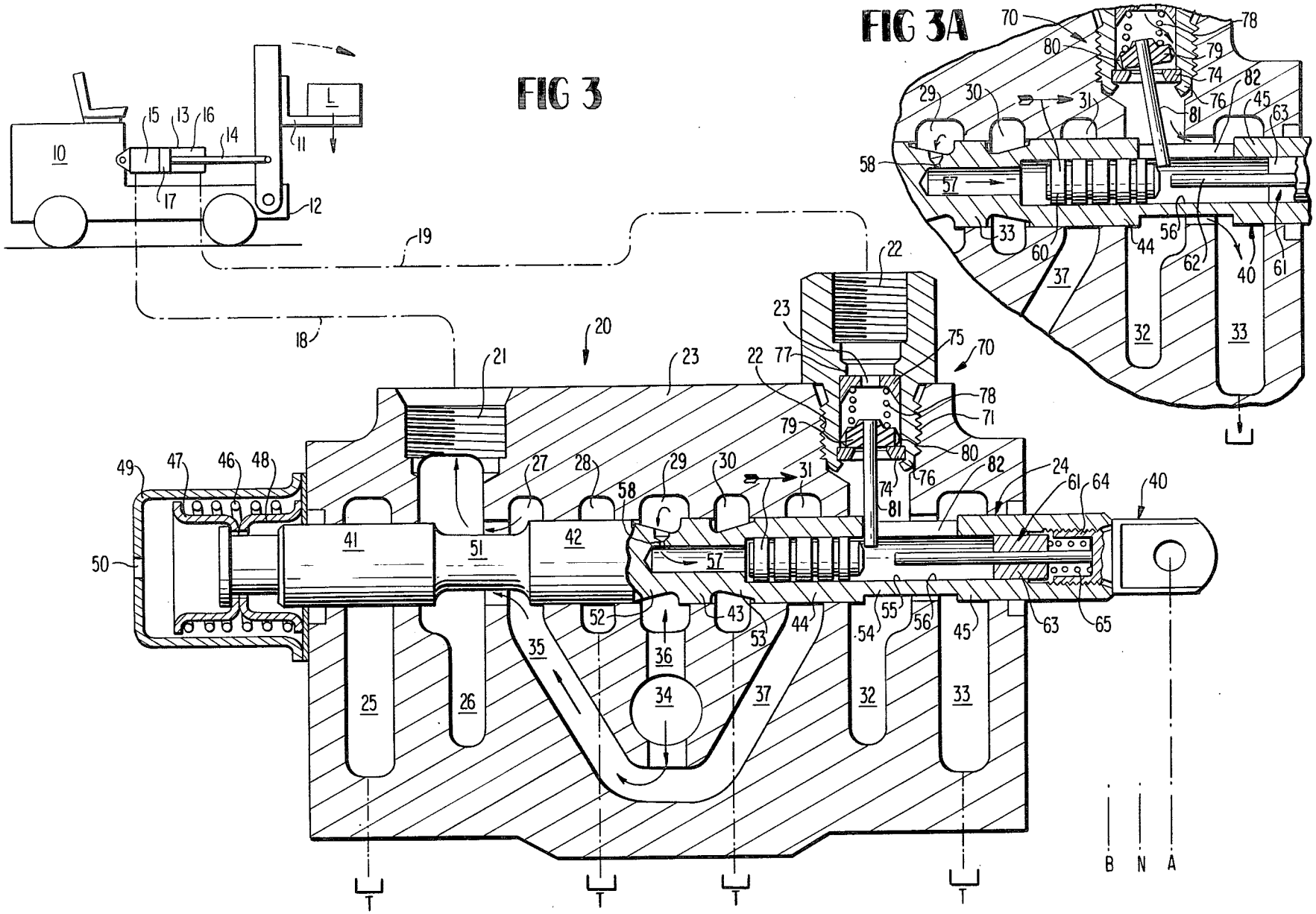
FIG. 3 shows a further schematic representation of the fluid control device wherein the control spool is preset into a second active position A.
FIG. 3A shows a partial schematic representation wherein the control spool is moved to the second active position A and hydraulic fluid forces actuate a piston to unseat the check valve.

When the control valve assembly 20 is selectively moved to the A position, the spool 40 assumes the position shown in FIG. 3.

Hydraulic fluid from pump P can only move through passageways 34 and 35, cavity 27 and into cavity 26. The pressurized fluid then flows, via fluid line 18, into chamber 15 of fluid motor 13. As the fluid pressure builds within chamber 15, piston 17 will attempt to move toward chamber 16, but cannot do so because of check valve 70. This results in the continued build-up of pressure within chamber 15.

Hydraulic fluid which continues to be pumped into cavity 29 flows through vent 58 into the cylindrical portion 57 of bore 55. Referring to FIG. 3A, pressure also builds up within the cylindrical portion 57 of bore 55 by virtue of the flow of hydraulic fluid from pump T into cavity 29 and from there into portion 57 by way of vent 58. This build up of pressure within portion 57 first causes piston 60 to move into abutting contact with rod 81 and, with the continuing build up of pressure within portion 57 causes piston 60 to tilt rod 81 and so open check valve 70. Piston 60 will continue to tilt rod 81 until making contact with rod 62, which prevents further movement of piston 60.

Because check valve 70 is now open, the hydraulic fluid in chamber 16 is vented into reservoir tank T allowing piston 17 and rod 14 to rotate support arm 11 in a clockwise direction.

Through the careful design of cylindrical portions 56 and 57 of passageway 55, as well as choosing a particular spring 78, the check valve 70 can be caused to open when the fluid pressure in chamber 15 exceeds the fluid pressure in chamber 16 by a predetermined amount, which insures sufficient fluid will at all times be present in chamber 15 preventing cavitation.

It is important to note that as soon as control valve assembly 20 is repositioned into the neutral position N, check valve 70 closes because of the direct fluid path again existing between pump P and reservoir tank T. This allows the operator to maneuver the support arm and elevated load L any amount within the range of the forklift vehicle.

Other modes of applying the principle of the invention may be employed, change being made as regards the details described, provided the features stated in any of the following claims, or the equivalent of such, be employed.

I therefore particularly point out and distinctly claim as my invention:

1. A directional control valve assembly for controlling the direction of pressurized fluid from a source of pressurized fluid, into and out of a fluid motor having first and second chambers and thereto a reservoir, said valve assembly comprising:

a valve body including a central passageway, a plurality of interconnected pressurized fluid conduits selectively supplyable with pressurized fluid, a plurality of spaced cavities in fluid communication with said central passageway and selectively connectable to a fluid reservoir;

said valve body further including first and second connecting ports through which fluid may flow out of or into said valve for further passage into or out of first and second chambers of a fluid motor;

a normally closed tiltable check valve assembly including a compression spring biased tiltable sealing member positioned transversely relative to said control passageway in a fluid passageway between said connecting port and an adjacent cavity for preventing fluid flow from said second connecting port into said adjacent cavity; and having a transversely extending elongated rod fixed at one end to said sealing member and having a further end extending into said adjacent cavity;

elongated cylindrically shaped spool means having inlet and exhaust portions and slidably positioned within said central passageway and including a plurality of cylindrically shaped land portions interconnected by cylindrically shaped portions of reduced diameter, a bore of varying diameter extending longitudinally through a portion of said spool means;

a narrow vent extending radially through said spool means from said central passageway to a smaller diameter portion of said bore, and an elongated aperture extending through a cylindrically shaped portion of said spool means into an enlarged diameter portion of said bore that adjoins said cavity adjacent said check valve for receiving said elongated rod into said enlarged diameter portion of said bore, said spool means being slidable between a neutral position for preventing fluid flow through both said first and second connecting ports, a first active position wherein pressurized fluid unseats said normally closed check valve to flow out of said second connecting port while exhaust fluid simultaneously flows into said first connecting port, and a second active position wherein pressurized fluid passes out of said first connecting port;

and a cylindrical piston slidably positioned within said enlarged diameter portion of said bore, whereby when said spool means is positioned in said second active position, hydraulic fluid flows into said bore through said narrow vent, fluid pressure increases within said bore to move said piston into abutting contact with said rod attached to said sealing member until pressure within said bore exceeds the pressure forcing said check valve to remain closed, whereupon said piston tilts said rod and attached sealing member thereby opening said second connecting port to drain a second chamber of a fluid motor to a reservoir.

2. A control valve assembly according to claim 1, wherein said central passageway extends completely through said valve body.

3. A control valve according to claim 2, wherein said spool means is of a greater length than said central passageway, with one end of said spool means being attached to a manual control for said valve and the opposite end of said spool means supporting a compression spring assembly for biasing said spool means into said neutral position.

4. A control valve according to claim 1, wherein at least one of said spaced cavities is always in fluid communication with said inlet portion of said spool means.

5. A control valve assembly according to claim 1, wherein said check valve assembly includes a cylindrically threaded portion mating with a correspondingly shaped threaded portion formed in said valve body.

6. A control valve assembly according to claim 1 wherein said check valve assembly includes first and second spaced hollow support members with said sealing member positioned therebetween.

7. A control valve according to claim 6, wherein said resilient sealing member is biased by said compression spring into abutting contact with said second support member blocking said flow passage through said check valve assembly.

8. A control valve assembly according to claim 7, wherein said resilient sealing member further includes a plurality of grooves forming a flow path around said resilient member when said member is unseated from abutting contact with said second support member.

9. A control valve device according to claim 1, wherein said spool means further includes an elongated rod extending in a longitudinal direction within a larger diameter portion of said bore for limiting the longitudinal travel of said piston.

* * * * *